US006386987B1

(12) United States Patent
Lejeune, Jr.

(10) Patent No.: US 6,386,987 B1
(45) Date of Patent: May 14, 2002

(54) GOLF CLUB

(76) Inventor: Francis E. Lejeune, Jr., 334 Garden Rd., River Ridge, LA (US) 70123

( * ) Notice: Subject to any disclaimer, the term of this patent is extended or adjusted under 35 U.S.C. 154(b) by 0 days.

(21) Appl. No.: 09/567,538

(22) Filed: May 5, 2000

(51) Int. Cl.[7] ..... A63B 69/36; A63B 53/04

(52) U.S. Cl. ..... 473/219; 473/242; 473/282; 473/324; 473/333

(58) Field of Search ..... 473/242, 238, 473/244, 245, 246, 247, 248, 226, 220, 221, 222, 223, 231, 131, 219, 329, 333, 288, 282, 324

(56) References Cited

U.S. PATENT DOCUMENTS 769,939 A * 9/1904 Clark
1,975,307 A 10/1934 Ackerman
3,259,387 A * 7/1966 Beigay
3,589,731 A 6/1971 Chancellor
3,893,673 A * 7/1975 Welch
4,170,357 A * 10/1979 Greer
4,411,430 A 10/1983 Dian
5,366,222 A 11/1994 Lee
5,390,920 A 2/1995 Nickum
5,433,446 A 7/1995 Lindstedt
5,441,269 A 8/1995 Henwood
5,788,587 A 8/1998 Tseng

* cited by examiner

*Primary Examiner*—Sebastiano Passaniti
(74) *Attorney, Agent, or Firm*—Garvey, Smith, Nehrbass & Doody, LLC; Charles C. Garvey, Jr.

(57) ABSTRACT

A golf club features a hollowed club head having an insert movably mounted therein. The insert is weighted so that it works like a pendulum during a user's swing of the club. The insert has a flat face that shifts to present a face to the ball that corrects for improper technique.

38 Claims, 3 Drawing Sheets

GOLF CLUB

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to golf clubs and more particularly to an improved golf club that has a hollow recess, receptacle or cavity that holds a moving insert. The insert provides a club face portion that shifts depending upon the orientation of the club shaft during the swing in order to correct for improper technique. The apparatus can be used as a teaching aid to indicate to the user when he or she has improperly supported the club during the swing.

2. General Background of the Invention

When a golfer swings a golf club and simultaneously supports the club in an improper orientation, the result is a ball that traverses a curved path. These curved paths of the golf ball are referred to as either a "hook" or a "slice". A hook refers to a ball flight path that curves to the left of the fairway. A slice is a golf ball flight path that travels in a curved path to the right of the fairway.

Some golf club constructions have been patented which attempt to help the golfer in his or her appointed task of driving the ball as far and as straight as possible.

The Ackerman U.S. Pat. No. 1,975,307 provides a head for golf sticks that provides in combination a head, a hammer loosely seated in the head, and a plate forming a striking face thereof and adapted to be struck by the hammer.

The Chancellor U.S. Pat. No. 3,589,731 discloses a golf head incorporating a hollow interior with a movable weight supported on a mounting rod which can be oriented in different angular positions to counteract the tendency of the golfer to hook or slice the ball and to increase the distance which the ball is driven due to the additional forces exerted on the ball by the movable weight. The movable weight is centered on the mounted rod by spring devices and the overall shape and configuration of the golf club head is not changed.

A golf putter is disclosed in U.S. Pat. No. 4,411,430. In the '430 patent, the golf putter provides a head with a front to rear elongated rod-like weight or ram encased in a transparent plastics material body and is provided with a rotatable rod or ram portion to shift the axial center of the mass of the head to correct malfunctioning variations and to correct errors in the putting stroke.

The Lee U.S. Pat. No. 5,366,222 discloses a wood golf club head that includes a golf club head cavity, and a permanent magnet plate attached to the back side of the club head cavity whereby upon hitting the golf ball, the steel ball moves and hits an inner sweet point corresponding to a sweet point of the front surface face of golf club head, so that the struck ball will fly in a straight direction and in a longer distance compared with an expected golf ball distance.

In the Nickum U.S. Pat. No. 5,390,920, there is disclosed a golf club having an adjustable head with a positive locking mechanism. The lower end of the golf club shaft terminates in a spherical ball which is restrained within a cooperating bore in the golf club head which permits free rotational and pivotal movement of the head with respect to the shaft. A locking screw, when tightened within the bore, holds the pivot ball in place against rotational and pivotal motion. A portion of the locking screw is designed to break off after tightening so that the position of the head cannot be changed during play.

In the Lindstedt U.S. Pat. No. 5,433,446, there is disclosed a device for insuring that directional stability is monitored and maintained in three axes when addressing a golf ball with a golf club. Visual alignment and club head positioning is obtained through the use of holograms affixed to the heads of the clubs so that a visual check by the holder of the club reveals the image or object in three dimensions when the dub is improperly positioned and in two dimensions when it is perfectly positioned. Image color (s) are also used to enhance recognition of proper club head positioning.

In the Henwood U.S. Pat. No. 5,441,269, there is disclosed a putting stroke training device. The critical features of the putting stroke training device of the '269 patent includes Y-axis sensor means for detecting and signaling whether the face of a putter strikes a golf ball perpendicular to the path of the putter head and X-axis sensor means for detecting and signaling any abnormal acceleration or deceleration of the putter head. The Y-axis sensor means is disposed in a Y plane that is perpendicular to the golf ball striking face. The X-axis sensor means is disposed in an X plane that is perpendicular to the Y plane and is in the same plane as the shaft. This putting stroke trainer will assist the golfer in striking the ball with the club face perpendicular to the path of the putter head, and in developing a smooth pendulum swing and avoiding the "yips".

In the Tseng U.S. Pat. No. 5,788,587 there is disclosed a centroid-adjustable golf club head, which can enable a user to strike a golf ball more stably and accurately. The centroid-adjustable golf club head includes a head body, a sphericity, a floating ball and liquid with large specific weight. The head body has anti vibration and thermoplastic elastomer disposed therein and defines a screw hold at a top thereof. The sphericity is disposed in the anti vibration and thermoplastic elastomer of the head body. The sphericity has a charging spout formed on a top thereof and aligned with the screw hole of the head body; and an elastic wafer disposed between the head body and the sphericity. The floating ball is disposed in the sphericity. The liquid with large specific weight is fed from the charging spout to the sphericity. With this arrangement, the centroid of the club head can be adjusted to an appropriate position, depending to the relative position of the liquid and the floating ball. Therefore, the user can strike the ball stably in any time and by any angle.

BRIEF SUMMARY OF THE INVENTION

The present invention provides an improved golf club that incorporates a compensating member or pendulum into the head of the club. The apparatus reacts to the swing of the golf club by the golfer, and tends to correct the imperfections in the user's technique.

The present invention accomplishes these goals by providing a weighted insert within the club's head that is moved by centrifugal forces generated during the down stroke of the swing. The weighted insert pivots about an axle and this in turn rotates the striking face of the club's head which is on the opposite side of the weighted unit.

A change of about six to ten degrees in the angle of the striking face may be thus effected. This angle change affects the direction of the golf ball as the club head of the driver contacts the ball. The direction of the flight of the ball is normal to or at right angles to the striking face of the club.

If the golfer's swing has an outward curve to it, a spin is imparted to the ball causing its flight to make a curve to the right. Such a curved travel path for the golf ball is commonly referred to as a slice.

By changing the direction of the start of the ball's flight three or four degrees to the left, the final landing point of the ball is moved back toward the center of the fairway, correcting its errant course.

If the golfer swing follows a more inward curve, producing a course known as a "hook", the weighted unit of the club head rotates in the opposite direction, pointing the face to the right approximately three to four degrees. This alteration of the ball's initial flight allows the spin of the ball to curve its course back to the left thus causing the ball's landing point to be close to the center of the fairway.

In one embodiment, an electric indicator can include a display with three small colored lights on the top of the club head indicating to the user which position the swinging weight unit assumed at the moment of contact with the ball.

In one embodiment, a spring or cable limits travel of the insert. In another embodiment, a pair of compression springs limits travel of the insert.

If the swing is perfectly straight, with the striking face driving the ball straight ahead, the white or center light illuminates or flashes.

If the swing has an outward curve so as to slice to the right, the green light illuminates or flashes.

If the swing has an inward curve, so as to hook the ball to the left, the red light illuminates or flashes. The apparatus of the present invention can be applied to drivers, wedges and/or any other golf club.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
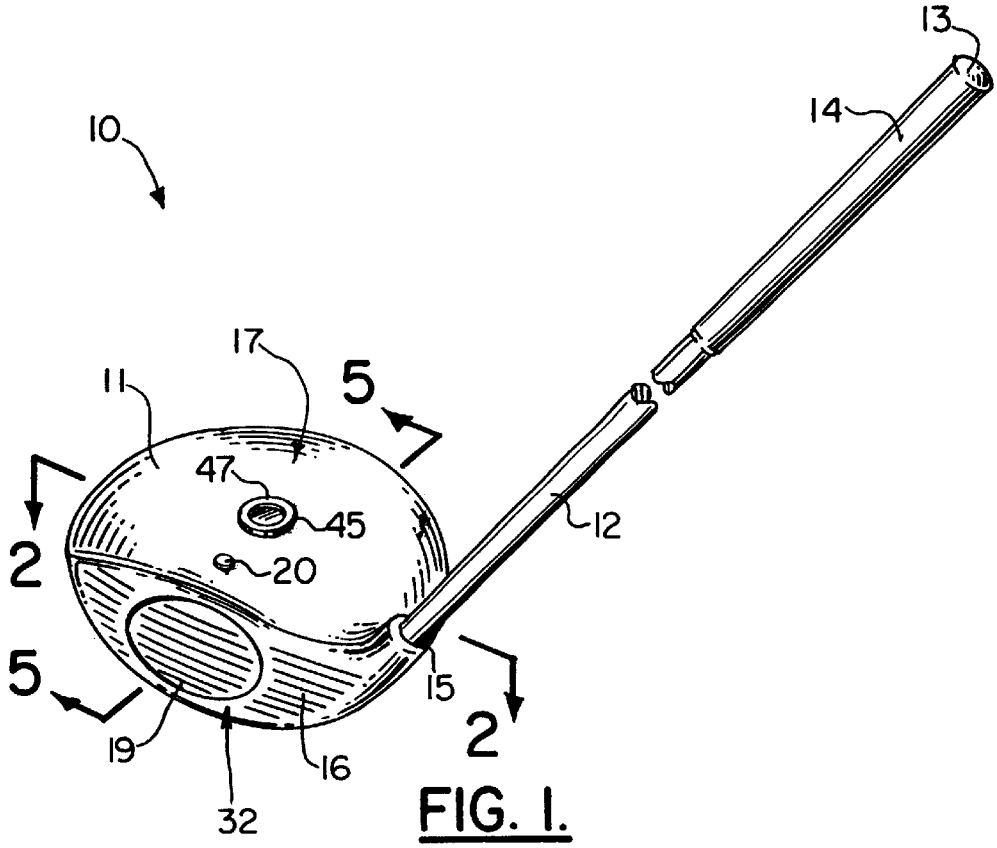
FIG. 1 is a perspective view of the preferred embodiment of the apparatus of the present invention.

FIG. 1 shows the preferred embodiment of the apparatus of the present invention designated generally by the numeral 10. Golf club 10 includes an elongated shaft 12 that supports club head 11. Shaft 12 has an upper end 13 and a lower end 15. The upper end 13 has gripping surface 14 that is the portion grasped by a user during play.

The club head 11 has an outer surface 17 that includes a generally flat face 16. In the preferred embodiment, an opening 32 (preferably oval, ovid or squared in shape) is provided through which weighted insert 19 extends. Opening 32 communicates with a cavity or receptacle 18 that is occupied by insert 19.

Insert 19 is a weighted insert, moving member or pendulum that can be seen in plan view in FIGS. 2–4 and 6–8. The sectional view of FIG. 5 gives a side view of the weighted insert 19.

Insert 19 attaches to club head 11 at pivot 20. Insert 19 has a flat face 21 that functions as a majority of the club face and is that portion that strikes the golf ball during use. Weighted insert 19 has an upper surface 22, lower surface 23, rear curved surface 24, a pair of angled surfaces 25, 26, and curved edges 27, 28 that extend between the flat face 21 and the respective angled surfaces 25, 26. Cavity 18 has curved surface 29, angled surfaces 30, 31, and opening 32 that communicates with face 16 of club head 11.

Figure 2:
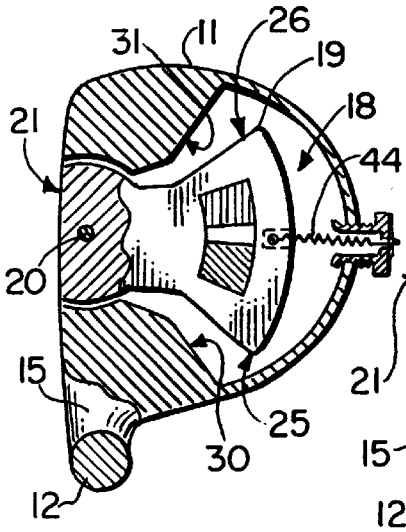
FIG. 2 is a sectional view taken along lines 2—2 of FIG. 1.
Figure 3:
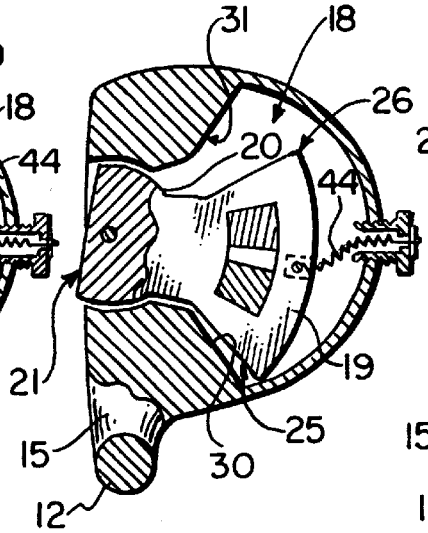
FIG. 3 is a sectional, partial plan view of the preferred embodiment of the apparatus of the present invention illustrating a shifted position of the weighted insert.

FIGS. 3–4 and 6–8 illustrate the position of weighted insert 19 during use. In FIG. 2, the weighted insert 19 is shown in a centered position within cavity 18. In FIG. 3, the weighted insert 19 has shifted toward the club shaft 12 so that the angled surface 25 approaches the surface 30 of cavity 18. This movement of weighted insert 19 is illustrated by arrow 33 in FIGS. 3 and 7.

Figure 4:
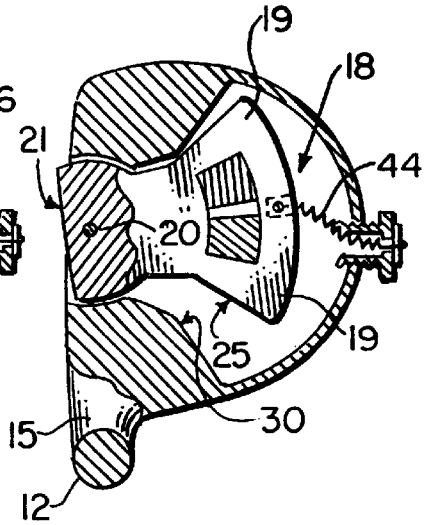
FIG. 4 is a sectional, partial plan view of the preferred embodiment of the apparatus of the present invention illustrating another shifted position of the weighted insert.
Figure 5:
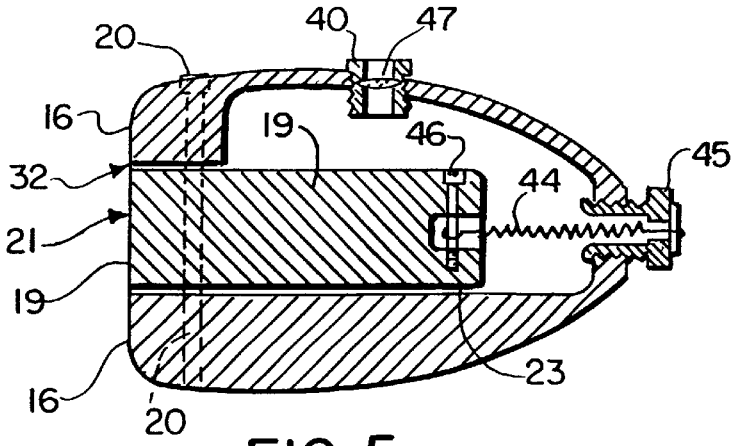
FIG. 5 is a sectional view taken along lines 5—5 of FIG. 1.

In FIG. 4, arrow 34 indicates that weighted element 19 has pivoted to a position that places it as far as possible away from shaft 12 wherein angled surface 26 engages surface 31 of cavity 18. Spring 44 functions as a stop for limiting pivotal movement of insert 19. Fitting 45 can be removably attached to club head 11, so that different springs 44 of different size, length, and/or tensile strength can be used with club 11 as desired. Spring 44 can be attached at one of its ends to insert 19 at pin 46 and at its other end to fitting 45.

Figure 6:
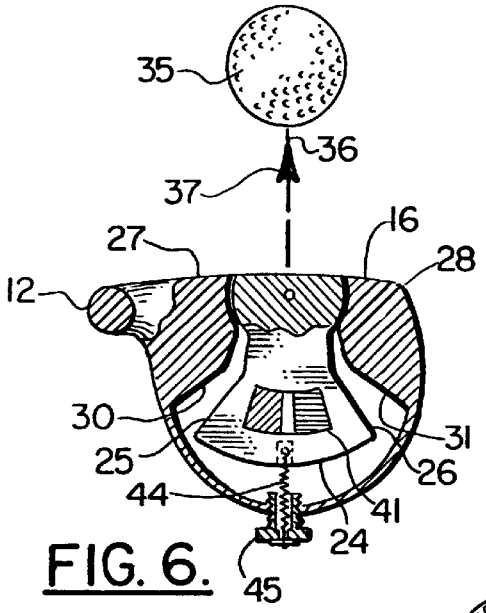
FIG. 6 is a plan, sectional view illustrating a centered position of the weighted elements and the ball flight path.
Figure 7:
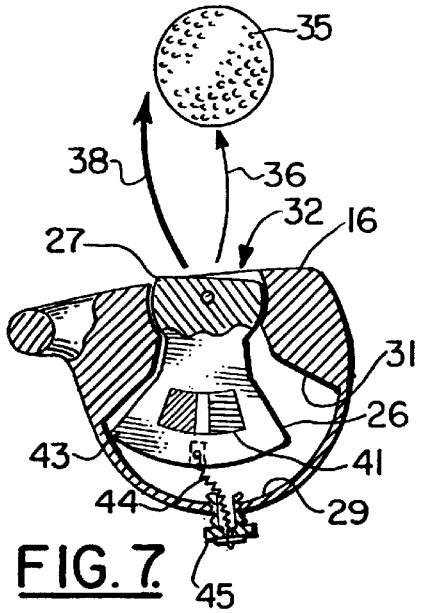
FIG. 7 is a plan sectional view of the preferred embodiment of the apparatus of the present invention illustrating a position of the weighted insert wherein it has shifted toward the club shaft.
Figure 8:
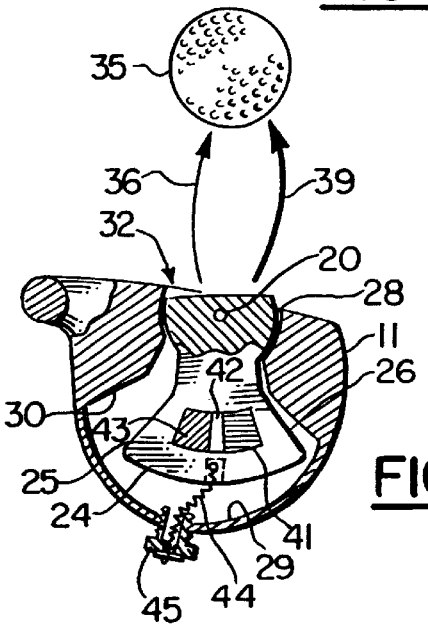
FIG. 8 is a plan sectional view of the preferred embodiment of the apparatus of the present invention illustrating a position of the weighted insert wherein it has shifted toward the club shaft.

In FIGS. 6–8, a golf ball 35 is shown after it has been hit by golf club 10. In FIG. 6, the golfer has perfected a smooth even swing so that the weighted element 19 remains centered in cavity 18 as indicated by arrow 37. The swing causes the golf ball to fly straight off of the face 21 in an intended direction, eg. down the center of the fairway. In FIG. 7, the golfer has produced a swing that tracks the path indicated by arrow 38 which typically would produce a "hook" travel path for the ball 35. However, in FIG. 7, weight element 19 has shifted to produce an angle between face 21 of element 19 and face 16 of club head 11. Thus, despite the golfer's errant swing, the ball 35 travels on a desired path (indicated by arrow 36) which brings its final resting point near the center of fairway.

In FIG. 8, the golfer produces a swing indicated by arrow 39 which typically would produce a slice travel path for the ball. However, the weighted insert element 19 has shifted in the direction of arrow 34 so that the flat face 21 on element 19 forms an angle with the club face 16 again, producing a travel path for ball 35 (as indicated by arrow 36) which brings its final resting point close to the center of the fairway.

In FIG. 1, the outer surface 17 of club head 11 can be provided with a colored zones indicator 40 that is comprised of a fitting having a bore with a lens 47. A plurality of colored lights 41, 42, or 43 are provided on upper surface 22 of insert. The center zone or light 42 would preferably be white, and would indicate a correct swing in that the weighted insert element 19 is centered, the position of FIG. 6. The zone or light 41 could be a color that would represent the position of FIG. 7, namely that the club has been swung along the path 38 causing the weighted element 19 to assume the innermost position of FIG. 7. In such a situation, the zone 41 would be seen when viewed through lines 47, to indicate with certain color (such as red) an inward curve that would have produced a hook travel path for the ball.

In the FIG. 8 orientation, the zone or light 43 would indicate with a selected color (such as green) an outward curve 39 so as to slice the ball toward the right. If desired, as an alternative to the colored zones 41, 42, 43, battery could be provided in the club head 11 or in the shaft 12 or insert 19 for powering lighted zones 41, 42, 43. Contact switches could be provided for illuminating either the light 41 or the light 43 when contact is made between either of the respective surfaces 24, 25 with respective surfaces 30, 31. If neither of the surfaces 30 or 31 were contacted by its adjacent angled surface 25, 26 respectively, a timer could be provided to simply illuminate the center light 42 after a few seconds.

Figure 9:
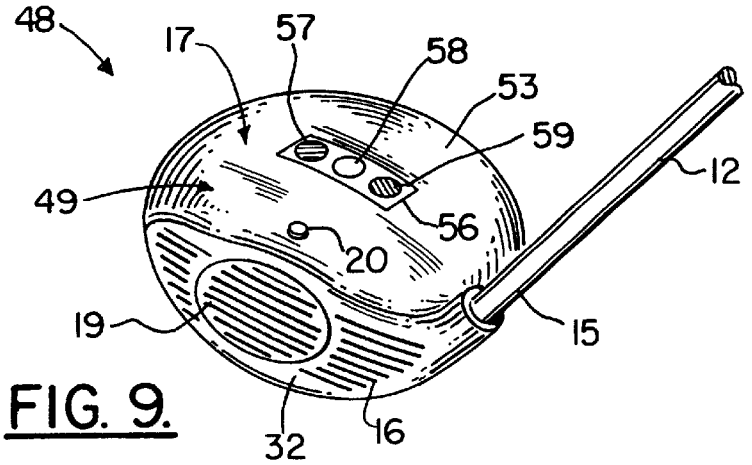
FIG. 9 is a perspective view of an alternate embodiment of the apparatus of the present invention.

FIGS. 9–12 illustrate an alternate embodiment of the apparatus of the present invention designated generally by the numeral 48 in FIG. 9. The weighted insert 19 of the embodiment of FIGS. 9–12 can be of a similar configuration, size and shape to the insert 19 shown in FIGS. 1–8. Thus, the weighted insert 19 in FIGS. 9–12 has the same numerical indicator 19 as in the preferred embodiment of FIGS. 1–9.

Golf club 48 has a shaft 12 with a lower end portion 15 that is similar to the shaft 12 shown and described in FIG. 1 with respect to the preferred embodiment. Shaft 12 joins to club head 53 at lower end 15. Club head 53 provided with a hollow interior or cavity 50 receiving insert 19. Insert 19 is movably attached to club head 53 at pivot 20.

The club head 53 has an outer surface 49 that carries an indicator panel 56 having three indicator lights 57, 58, 59 that can be electrically powered (eg. battery). These indicator lights 57, 58, 59 are used to provide an indication of whether the weighted insert 19 has shifted to the position shown in either of the FIG. 10, 11 or 12.

Figure 10:
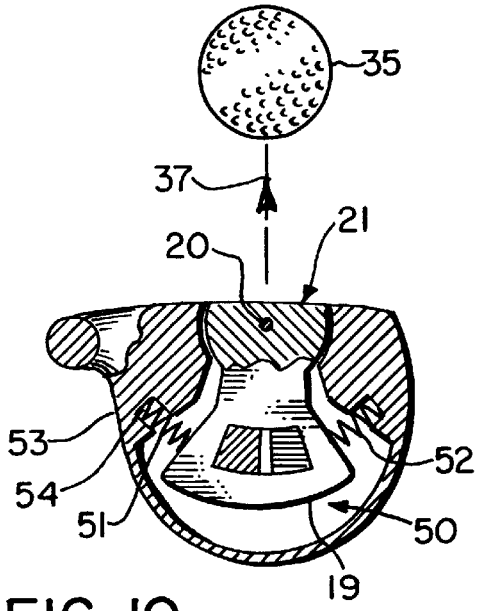
FIG. 10 is a sectional, partial plan view of the alternate embodiment of the apparatus of the present invention illustrating a centered position of the weighted insert.
Figure 11:
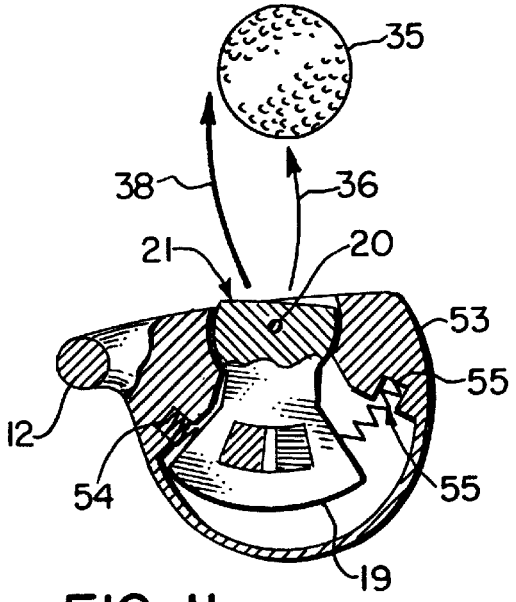
FIG. 11 is a sectional, partial plan view of the alternate embodiment of the apparatus of the present invention illustrating a shifted position of the weighted insert.

A pair of springs 51, 52 are used to center the insert 19 to the position shown in FIG. 10. If the golfer improperly manipulates the club 48 so that the weighted insert 19 moves toward shaft 12 as shown in FIG. 11, an electrical circuit (not shown) lights the indicator light 59 (eg. a red light) to indicate a hook condition. Such a circuit can simply be contacts that are on weighted insert 19 that engage other respective contacts at surfaces 30 or 31 of club head 11 or 53. As with the preferred embodiment, the weighted element 19 in the shifted position presents a flat face 21 that compensates for this error and directs the ball on a path that brings its final resting point near the desired center of the fairway.

Figure 12:
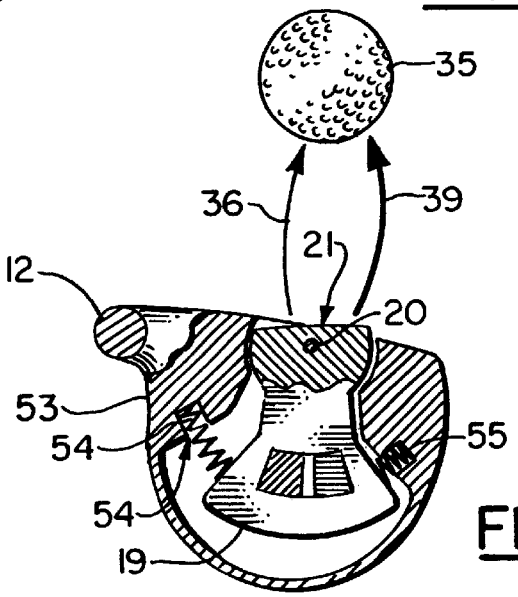
FIG. 12 is a sectional, partial plan view of the alternate embodiment of the apparatus of the present invention illustrating another shifted position of the weighted insert.

In FIG. 12, the weighted insert shifts to a position away from the club shaft 12, as occurs during a "slice" error by the golfer. In such a case, the indicator light 57 (eg. green light) illuminates or flashes. As with the preferred embodiment, the flat face 21 of the weighted insert 19 shifts positions so that despite the golfer's errant swing, the ball 35 travels along a desired path (indicated generally by arrow 36) which brings its final resting point near the center of the fairway as desired. When the weighted insert 19 is centered (FIG. 10) the center light (eg. white) 58 illuminates or flashes.

The springs 51,. 52 in the embodiment of FIGS. 9–12 are preferably compression type springs, each mounted in its respective socket 54, 55 as shown in FIGS. 10–12.

The following is a list of parts and materials suitable for use in the present invention:

PARTS LIST

| Part Number | Description |
|---|---|
| 10 | golf club |
| 11 | club head |
| 12 | shaft |
| 13 | upper end |
| 14 | gripping surface |
| 15 | lower end |
| 16 | flat face |
| 17 | outer surface |
| 18 | cavity |
| 19 | insert |
| 20 | pivot |
| 21 | flat face |
| 22 | upper surface |
| 23 | lower surface |
| 24 | curved surface |
| 25 | angled surface |
| 26 | angled surface |
| 27 | edge |
| 28 | edge |
| 29 | curved surface |
| 30 | surface |
| 31 | surface |
| 32 | opening |
| 33 | arrow |
| 34 | arrow |
| 35 | golf ball |
| 36 | arrow |
| 37 | arrow |
| 38 | arrow |
| 39 | arrow |
| 40 | indicator |
| 41 | zone/light |
| 42 | zone/light |
| 43 | zone/light |
| 44 | spring |
| 45 | fitting |
| 46 | pin |
| 47 | lens |
| 48 | golf club |
| 49 | outer surface |
| 50 | cavity |
| 51 | spring-compression type |
| 52 | spring-compression type |
| 53 | club head |
| 54 | socket |
| 55 | socket |
| 56 | indicator panel |

-continued

PARTS LIST

| Part Number | Description |
|---|---|
| 57 | indicator light |
| 58 | indicator light |
| 59 | indicator light |

The foregoing embodiments are presented by way of example only; the scope of the present invention is to be limited only by the following claims.

What is claimed is:

1. A golf club comprising:

a) a club shaft having opposing end portions, one end portion being an upper end portion having a handle with a gripping surface, the other end portion being a lower end portion;

b) a club head attached to the lower end portion, said head having an outer surface that includes a static club face portion that faces toward a golf ball to be driven with the club during use;

c) the club head static club face portion having a cavity;

d) a weighted element movably mounted to the club head at the cavity, said element having a moving club face portion; and e) said weighted element being configured and positioned at the cavity so that the moving club face portion can rotationally change positions relative to the static club face portion during a swing of the club shaft depending upon changes in the rotational position of the club head relative to the shaft central longitudinal axis.

2. The golf club of claim 1 wherein the cavity is a hollowed interior of the club head, and a majority of the weighted element is contained within the hollowed interior of the club head.

3. The golf club of claim 2 wherein said weighted element is at least partially housed within said hollowed interior.

4. The golf club of claim 1 wherein the weighted element moving club face portion is positioned to engage a golf ball during use.

5. The golf club of claim 4 wherein the moving club face portion is of a generally oval shape.

6. The golf club of claim 1 wherein the club head static face portion includes an opening that is part of the cavity, and said element at least partially occupies said opening.

7. The golf club of claim 1 further comprising means for limiting the degree of movement of the weighted element.

8. The golf club of claim 7 wherein the limiting means includes a link member joining the club head and the weighted element.

9. The golf club of claim 8 wherein the link member is a cable.

10. The golf club of claim 8 wherein the link member is a spring.

11. The golf club of claim 8 wherein the weighted element is connected to a rear of the club head with the link member.

12. The golf club of claim 7 wherein the limiting means includes stops that limit movement of the weighted element.

13. A golf club comprising:

a) a club shaft having opposing end portions, one end portion being an upper end portion having a handle with a gripping surface, the other end portion being a lower end portion;

b) a club head attached to the lower end portion, said head having an outer surface that includes a static club face that defines a plane;

c) the club head having a cavity;

d) a weighted element movably mounted to the club head at the cavity, said element having a moving club face portion; and e) said weighted element being configured and positioned at the cavity so that the moving club face portion can rotationally change positions relative to the plane containing the static club face during a swing of the club shaft depending upon changes in the rotational position of the club head relative to the shaft central longitudinal axis, wherein the weighted element is pivotally attached to the club head.

14. The golf club of claim 2 wherein the weighted element pivots about an axis that is generally parallel to the central longitudinal axis of said shaft.

15. The golf club of claim 13 wherein the weighted element pivots about an inclined axis.

16. A golf club comprising:

a) a club shaft having opposing end portions, one end portion being an upper end portion having a handle with a gripping surface, the other end portion being a lower end portion;

b) a club head attached to the lower end portion, said club head having an outer surface that includes a front surface portion defining a plane that faces forward during use in the general direction that the golf ball is to be driven, said front surface having an opening;

c) a weighted element movably mounted to the club head, said element having a moving club face portion that engages the golf ball when the club shaft is swung to strike a golf ball, the moving club face portion occupying the opening; and d) said weighted element being configured and positioned at the cavity so that the moving club face portion can change positions rotationally relative to the plane containing the front surface portion during a swing of the club shaft depending upon changes in the rotational position of the club head relative to the shaft central longitudinal axis.

17. A golf club comprising:

a) a club shaft having opposing end portions, one end portion being an upper end portion having a handle with a gripping surface, the other end portion being a lower end portion;

b) a club head attached to the lower end portion, said head having an outer surface that includes a front surface portion that faces forward during use in the general direction that the golf ball is to be driven, said front surface portion having an opening;

c) a weighted element movably mounted to the club head, said element having a face portion that engages the golf ball when the club shaft is swung to strike a golf ball, the face portion occupying the opening;

d) wherein said weighted element is configured and positioned so that the face portion can change positions relative to the plane containing the front surface portion during a swing of the club shaft depending upon changes in the rotational position of the club head relative to the shaft central longitudinal axis; and e) wherein the weighted element is pivotally attached to the club head.

18. The golf club of claim 17 wherein the cavity is a hollowed interior of the club head, and a majority of the weighted element is contained within the hollowed interior of the club head.

19. The golf club of claim 17 wherein the weighted element has a flat surface portion that is positioned to engage a golf ball during use.

20. The golf club of claim 19 wherein the flat surface portion is generally rectangular.

21. The golf club of claim 17 wherein the weighted element pivots about an axis that is generally parallel to the central longitudinal axis of said shaft.

22. The golf club of claim 17 wherein the weighted element pivots about an inclined axis.

23. The golf club of claim 17 wherein said weighted element is at least partially housed within said hollowed interior.

24. The golf club of claim 17 wherein the club head has a face with an opening, and said element at least partially occupies said opening.

25. A golf club comprising:

a) a club shaft having opposing end portions, one end portion being an upper end portion having a handle with a gripping surface, the other end portion being a lower end portion;

b) a hollow club head having a hollow interior attached to the lower end portion, said head having an outer surface that includes a front surface portion that defines a plane and faces forward during use in the general direction that the golf ball is to be driven, said front surface portion having an opening;

c) a weighted element movably mounted to the club head and occupying the hollow interior, said element having a moving face portion that engages the golf ball when the club shaft is swung to strike a golf ball, the moving face portion occupying the opening; and d) wherein said weighted element is configured and positioned so that the moving face portion can change positions relative to the plane of the front surface portion to form an acute angle therewith during a swing of the club shaft depending upon changes in the rotational position of the club head relative to the shaft central longitudinal axis.

26. The golf club of claim 25 wherein the weighted element has a flat surface portion that is positioned to engage a golf ball during use.

27. The golf club of claim 26 wherein the flat surface portion is of a generally oval shape.

28. The golf club of claim 25 wherein the weighted element pivots about an axis that is generally parallel to the central longitudinal axis of said shaft.

29. The golf club of claim 25 wherein the weighted element pivots about an inclined axis.

30. The golf club of claim 25 wherein said weighted element is at least partially housed within said hollowed interior.

31. The golf club of claim 25 wherein the club head front surface portion has an opening that is part of the hollow interior, and said element at least partially occupies said opening.

32. The golf club of claim 25 further comprising means for limiting the degree of movement of the weighted element.

33. The golf club of claim 32 wherein the limiting means includes a link member joining the club head and weighted element.

34. The golf club of claim 33 wherein the link member is a cable.

35. The golf club of claim 33 wherein the link member is a spring.

36. The golf club of claim 33 wherein the weighted element is connected to a rear of the club head with the link member.

37. The golf club of claim 32 wherein the limiting means includes stops that limit movement of the weighted element.

38. The golf club of claim 25 wherein the weighted element is pivotally attached to the club head.

* * * * *